United States Patent [19]

Walton

[11] Patent Number: 4,698,853

[45] Date of Patent: Oct. 13, 1987

[54] PROTECTIVE GARMENT FOR HAIR AND CLOTHING

[76] Inventor: Patricia A. Walton, 6002 Waters Dr., Savannah, Ga. 31406

[21] Appl. No.: 19,963

[22] Filed: Feb. 27, 1987

[51] Int. Cl.[4] ..... A42B 1/18

[52] U.S. Cl. ..... 2/174

[58] Field of Search ..... 2/174

[56] References Cited

U.S. PATENT DOCUMENTS 3,138,801 6/1964 Brodsky ..... 2/174

4,457,027 7/1984 Gladstone ..... 2/174

*Primary Examiner*—Doris L. Troutman

*Attorney, Agent, or Firm*—Newton, Hopkins & Ormsby

[57] ABSTRACT

A protective garment is disclosed which can be worn about the head and shoulders of a user to protect clothing that is being put on or removed from becoming damaged by contact with the user's cosmetics, coiffure, and facial oils or entanglement with the user's jewelry. The garment is constructed of lace-like material which is lightweight and which does not inhibit the user's vision. A ring member in the upper portion of the garment upon which the material is gathered and an elastic member near the lower portion of the garment, permit its expansion to be comfortably donned and to enclose the wearer's head and hair without disturbing the coiffure.

17 Claims, 3 Drawing Figures

PROTECTIVE GARMENT FOR HAIR AND CLOTHING

BACKGROUND OF THE INVENTION

1. Field of the Invention

The invention relates to a veil-like garment adapted to be worn about the head and shoulders of a user to protect clothing that is being put on or removed from becoming soiled by contact with the user's cosmetics, facial oils, perfumes or hair dressing. Further, this invention will prevent the garment, while being drawn on or removed, from becoming torn or snagged as a result of entanglement with any jewelry worn by the user, such as a necklace or earrings. This invention relates to a garment that can be made economically, that provides for comfortable and convenient use, and that can be disposable. The garment is particularly well suited for use in the retail garment sales industry.

The retail garment sales industry incurs an enormous expense annually resulting from customers soiling garments unintentionally while trying these garments on. Although the problem is experienced by stores ranging from large department stores to the small boutique, it is particularly vexatious to those small exclusive dress shops that handle a small volume of more expensive garments. The soiling results from contact between the garment and the customer'hair and face. Cosmetics, lipstick, hairspray, facial oil and perfume odors can be readily transferred to a fine garment through inadvertent contact. This soiling will necessitate either the mark down of the garment's sales price or dry cleaning which will prevent the garment from being sold as a new garment.

2. Prior Art

Devices to prevent the soiling of garments which are designed to cover the hair and face of the customer have generally been cumbersome to don, uncomfortable to wear, and complex in construction.

Patents of interest are the Taylor U.S. Pat. No. 2,017,328, the Gettinger design U.S. Pat. No. D 205,829, and the Gladstone U.S. Pat. No. 4,457,027. The patent to Taylor teaches a garment protector that is reversible and features a ring with a number of snaps, which ring can be adjusted to be large or small to fit about the head or neck of the user depending upon whether a garment is being put on or removed. The design patent to Gettinger depicts a protective hood with a cord for tying the bottom of the garment around the neck. The patent to Gladstone teaches the provision of an elastic band in the neck area that permits initial expansion of a bottom aperture for placing the garment over the head of the user.

SUMMARY OF THE INVENTION

Of principal concern in connection with the invention is the provision of a device to protect clothing from the wearer's cosmetics, hair dressing, facial oils, and jewelry: that is convenient to wear, economical to make, light in weight, and which offers unobstructed vision. The present invention provides a lace-like garment which offers the wearer an unobstructed view when drawn over the wearer's face.

The protective device contains a channel means at the top edge for retaining a ring means having the endpoints joined together. The ring serves the dual purpose of gathering the fabric around its circumference and of retaining the device on the top of a wearer's head.

There is an intermediate part to the device which contains an additional channel means which serves to retain a resilient band means. At the extreme ends of the channel there is provided a fastening means such as a snap or velcro tabs. The function of the resilient band means and fastening means is to gather the intermediate part of the device around the neck of the wearer so that it can be kept comfortably in place while putting on or removing clothes. Since the lace-like garment is rectangular or trapezoidal in shape before the ring and elasticized band are inserted, there is a vertical opening formed when worn that can be either closed or opened as the user chooses. However, even when fully closed, the user is provided an unobstructed view through the substantially transparent fabric.

Finally, below the intermediate part is a skirt-like section that drapes over the shoulders and upper torso of the wearer to protect the garment from being snagged by any jewelry worn about the user's neck.

A feature of this invention which makes it particularly desirable is the fact that the device is not pulled on or drawn over the user's head as are most prior art devices. It is simply positioned upon the wearer's head and then fastened at the neck. What this accomplishes and what appears to be a solution to the objection to other devices is that there is no rubbing contact with the wearer's face or hair when the present device is put on over the head of the wearer. This eliminates the smudging of cosmetics and the dissheveling of hair styles.

Various additional objects and advantages will become apparent from the following description, with reference to the accompanying drawings.

BRIEF DESCRIPTION OF THE DRAWING FIGURES

These and other features of the present invention will become more apparent with reference to the figures.

DETAILED DESCRIPTION OF THE PREFERRED EMBODIMENT

Figure 1:
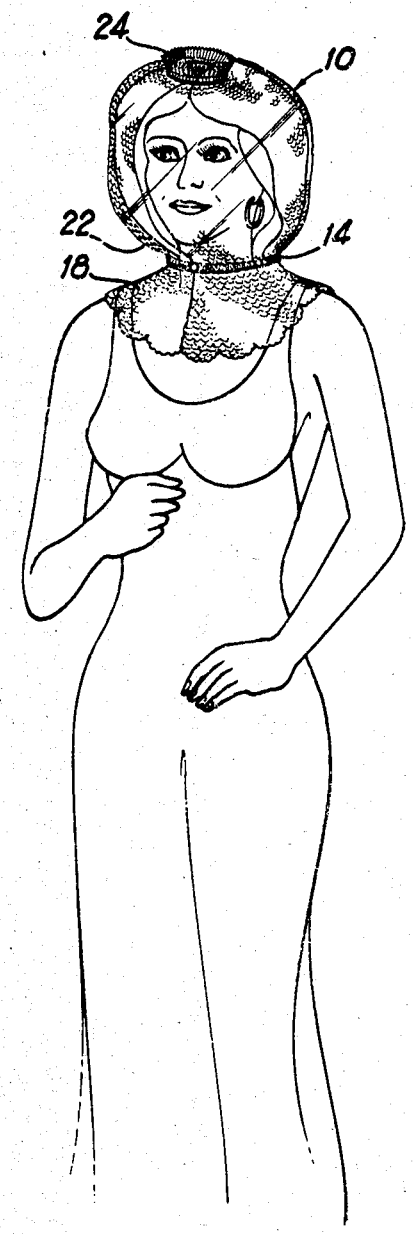
FIG. 1 is a perspective view of the invention, shown here in place around the head of the wearer.

Referring now more specifically to the drawings, and to FIG. 1 in particular, there is shown a perspective view of the protective device 10 as it is intended to be worn by a user before trying on clothing. The garment is formed of a veil-like material such as plain net or tulle. The choice of fabric depends upon many factors, such as the expense the provider of the garment is willing to accept. The more costly tulle may be appropriate in the smaller specialty shops in which the store owner want to project a quality image. Protective devices made from tulle would be less likely to be considered disposable. On the other hand, the plain net material may be more appropriate in department stores doing a high volume of business. With such a construction, the device is more likely to be disposable.

The fabric is initially cut into a rectangular or trapezoidal shape which will allow the garment to be gathered at the top portion 24 and the intermediate portion 22 so that it can be comfortably draped over the user's face while being retained in place by a ring means 12 and a resilient band means 14. The ring 12 consists of a length of flexible plastic tubing, the endpoints of which can be joined to form a generally circular entity. The ring 12 is retained in a channel means or passageway 13 sewn into the top portion 24 of the garment 10, near the upper edge thereof. The circumference of the ring is much less than the width of the fabric, thereby allowing the gathering of the fabric on the ring.

The ring 12 is inserted through the passageway in the top portion 24 and then joined at its endpoints. In the process, the fabric of the garment 10 is gathered at the top and enables it to be positioned on the head of the user and draped over her face. This gathering also provides a distinct advantage over prior art devices in that there is sufficient fabric to accomodate most hairstyles, including those termed bouffants.

In the embodiment shown, there is also sewn into the intermediate portion 22 a channel means such as passageway 23 pocket for retaining an elastic band 14. The elastic band 14 serves to gather the garment 10 and to allow its expansion so that it can be expanded to fit over the head and fastened around the neck of the user.

Fastening means 16 are provided near the endpoints of the passageway for retaining the garment 10 around the wearer's neck. Suitable types of fasteners may include snap tabs and hook and loop fasteners such as that sold under the trademark Velcro ®.

When the garment 10 is positioned on the head and fastened about the neck of the user, there is created a means defining an opening 20 which can be pulled closed or opened as the wearer desires. Normally, the opening is substantially vertical and will be pulled closed when the wearer puts on or removes clothing so that the wearer's face will not come into direct contact with the clothing. It can then be spread open to enable the wearer to view her appearance in the clothing without having to look through the veil-like material of the garment 10.

Figure 2:
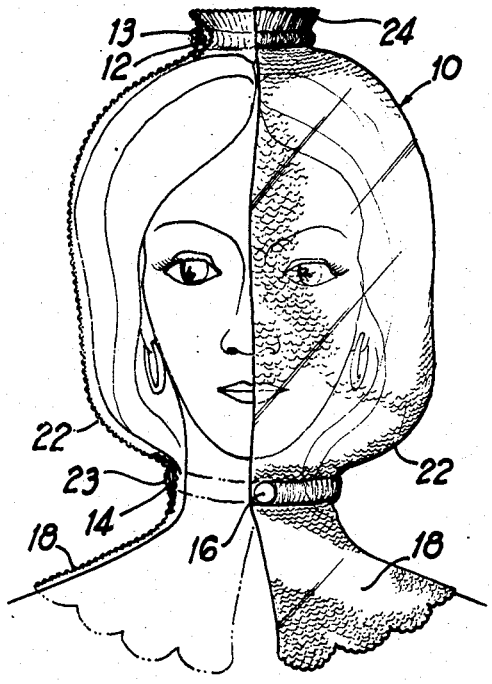
FIG. 2 is a front elevational view of the invention, shown partially in cross-section.
Figure 3:
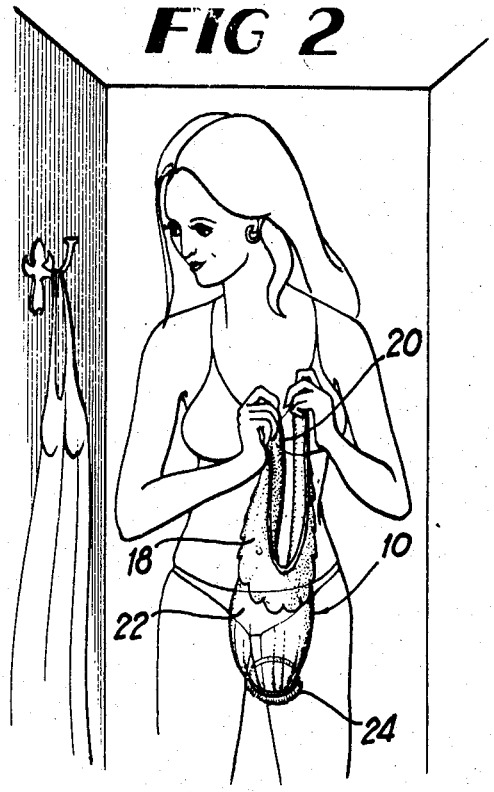
FIG. 3 is a perspective view indicating a user about to put on the protective device.

Below the intermediate portion 22 of the garment 10 is a skirt means 18 that drapes over the neck and upper torso of the wearer. In the preferred embodiment shown in FIGS. 1 through 3, the skirt 18 is the lower most portion of the garment 10 and is part of the initial rectangular or trapezoidal cut of fabric. In an alternate embodiment, the skirt 18 can be a separate piece of fabric stitched to the garment 10 at the intermediate portion 22. The skirt will prevent any jewelry worn about the neck of the wearer from becoming entangled with the clothes being put on or removed.

In summary, the present invention provides a light weight, economical device which will protect the clothing inventory of dress shops or department stores from becoming soiled or damaged by contact with cosmetics, hair spray, or jewelry worn by the user. The device is acceptable to customers since it can be put on or removed with minimal contact with the face or hair style. The device differs from most prior art devices in that it does not require pulling the device over the head and face of the wearer to don the garment and a modification thereof.

While an embodiment of a protective garment and a modification thereof has been shown and described in detail herein, various additional changes and modifications may be made without departing from the scope of the present invention.

What is claimed is:

1. A protective garment to protect clothes from becoming soiled or damaged by contact with cosmetics or jewelry when the clothes are put on or removed by a user, said garment comprising:

a thin fabric means having a top portion, an intermediate portion, a skirt portion and a means defining a frontal opening and adapted to be worn about the head and shoulders of the user;

a first passageway sewn into said top portion of said fabric means;

a ring means disposed in said first passageway for gathering said top portion of said fabric and for positioning said garment upon the head of the user;

a second passageway sewn into said intermediate portion of said fabric means;

resilient means disposed in said second passageway for gathering said intermediate portion of said fabric and for contracting said garment into position around the neck of the user; and fastening means disposed near the opposed ends of said means defining a frontal opening for securing said garment about the neck of the user.

2. A garment as claimed in claim 1 wherein said ring means is a flexible length of tubing.

3. A garment as claimed in claim 1 wherein said resilient means comprises an elastic band having opposed endpoints extending throughout said second passageway.

4. A garment as claimed in claim 3 wherein said fastening means are disposed near said endpoints of said elastic band and include hook and loop fastening means.

5. A garment as claimed in claim 1 wherein said fastening means include snap tabs.

6. A garment as claimed in claim 1 wherein said fabric means comprise plain netting.

7. A garment as claimed in claim 1 wherein said lace-like fabric comprises tulle.

8. A garment as defined in claim 1 in which said skirt portion extends radially from said second passageway throughout the length thereof for covering the neck of the wearer.

9. A garment as defined in claim 8 in which the circumference of said ring means is less than the width of said fabric means for gathering said fabric means on said ring.

10. A protective garment to protect clothes from becoming soiled or damaged by contact with cosmetics or jewelry when the clothes are put on or removed by a user comprising a fabric means having a top portion with a first passageway sewn into said fabric means;

a ring means disposed in said first passageway for gathering said top portion of said fabric means and for positioning said garment upon the head of the user;

an intermediate portion having a second passageway sewn into said fabric means;

resilient means disposed in said second passageway for gathering said intermediate portion of said fabric means and for contracting said garment into position around the neck of the user;

a skirt portion extending radially from said second passageway throughout the length thereof for covering the neck of the wearer;

means defining a frontal opening extending the length of said fabric means from said top portion through said intermediate portion and from said intermediate portion through said skirt portion; and fastening means disposed near opposed ends of said means defining a frontal opening for securing said garment about the neck of the user.

11. A garment as claimed in claim 10 wherein said ring means is a flexible length of tubing.

12. A garment as claimed in claim 10 wherein said resilient means comprises an elastic band having opposed endpoints and extending throughout said second passageway.

13. A garment as claimed in claim 12 wherein said fastening means are disposed near said endpoints of said elastic band and include hook and loop fastening means.

14. A garment as claimed in claim 10 wherein said fastening means include snap tabs.

15. A garment as claimed in claim 10 wherein said fabric means comprise plain netting.

16. A garment as claimed in claim 10 wherein said fabric means comprises tulle.

17. A garment as defined in claim 10 in which the circumference of said ring means is less than the width of said fabric means for gathering said fabric means on said ring.

* * * * *